US010772798B2

(12) United States Patent
Lev et al.

(10) Patent No.: US 10,772,798 B2
(45) **Date of Patent: *Sep. 15, 2020**

(54) LIQUID TRANSFER DEVICE WITH INTEGRAL TELESCOPIC VIAL ADAPTER FOR USE WITH INFUSION LIQUID CONTAINER AND DISCRETE INJECTION VIAL

(71) Applicant: West Pharma. Services IL, Ltd., Ra'anana (IL)

(72) Inventors: Amir Lev, Kfar Saba (IL); Igor Denenburg, Gedera (IL); Uri David, Nes Ziona (IL)

(73) Assignee: WEST PHARMA SERVICES IL, LTD., Ra'anana (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/467,370

(22) PCT Filed: Nov. 30, 2017

(86) PCT No.: PCT/IL2017/051308

§ 371 (c)(1),
(2) Date: Jun. 6, 2019

(87) PCT Pub. No.: WO2018/104932

PCT Pub. Date: Jun. 14, 2018

(65) Prior Publication Data

US 2020/0093692 A1 Mar. 26, 2020

(30) Foreign Application Priority Data

Dec. 6, 2016 (IL) ..... 249408

(51) Int. Cl.

| | |
|---|---|
| ***A61J 1/20*** | (2006.01) |
| ***A61J 1/14*** | (2006.01) |
| ***A61J 1/10*** | (2006.01) |

(52) U.S. Cl.
CPC ..... *A61J 1/2096* (2013.01); *A61J 1/10* (2013.01); *A61J 1/1418* (2015.05); *A61J 1/201* (2015.05);
(Continued)

(58) Field of Classification Search
CPC ..... A61J 1/2089; A61J 1/2058; A61J 1/2041; A61J 1/1418; A61J 1/10; A61J 1/201
See application file for complete search history.

(56) References Cited

U.S. PATENT DOCUMENTS

| | | | |
|---|---|---|---|
| 62,333 | A | 2/1867 | Holl |
| 247,975 | A | 10/1881 | Wickes |

(Continued)

FOREIGN PATENT DOCUMENTS

| | | |
|---|---|---|
| CA | 2946559 | 10/2015 |
| CA | 2946559 A1 | 10/2015 |

(Continued)

OTHER PUBLICATIONS

Grifols Vial Adapter Product Literature, 2 pages, Jan. 2002. cited by other.

(Continued)

*Primary Examiner* — Tatyana Zalukaeva
*Assistant Examiner* — Gabriella E Burnette
(74) *Attorney, Agent, or Firm* — Panitch Schwarze Belisario & Nadel LLP

(57) ABSTRACT

Liquid transfer devices with an integral telescopic vial adapter for use with an infusion liquid container and an initially non-punctured intact discrete injection vial. The integral telescopic vial adapter is configured for initial telescopic snap mounting on a discrete injection vial leaving its injection vial stopper non-punctured until a subsequent compaction for puncturing the injection vial stopper. The integral telescopic vial adapter includes a safety catch
(Continued)

mechanism for precluding advertent compaction from a pre-compacted state to a compacted state. The integral telescopic vial adapter includes a clamping arrangement for irreversibly clamping same in its final compacted state.

10 Claims, 12 Drawing Sheets

(52) U.S. Cl.
CPC ..... *A61J 1/2041* (2015.05); *A61J 1/2058* (2015.05); *A61J 1/2089* (2013.01); *A61J 1/2048* (2015.05)

(56) References Cited

U.S. PATENT DOCUMENTS 254,444 A 2/1882 Vogel
300,060 A 6/1884 Ford
1,021,681 A 3/1912 Jennings
1,704,817 A 3/1929 Ayers
1,930,944 A 10/1933 Schmitz, Jr.
2,326,490 A 8/1943 Perelson
2,560,162 A 7/1951 Garwood
2,748,769 A 6/1956 Huber
2,830,587 A 4/1958 Everett
2,931,668 A 4/1960 Baley
2,968,497 A 1/1961 Treleman
3,059,643 A 10/1962 Barton
D198,499 S 6/1964 Harautuneian
3,225,763 A 12/1965 Waterman
3,277,893 A 10/1966 Clark
3,308,822 A 3/1967 De Luca
3,484,849 A 12/1969 Huebner et al.
3,618,637 A 11/1971 Santomieri
3,757,981 A 9/1973 Harris, Sr. et al.
3,782,365 A 1/1974 Pinna
3,788,524 A 1/1974 Davis et al.
3,822,700 A 7/1974 Pennington
3,826,261 A 7/1974 Killinger
3,872,992 A 3/1975 Larson
3,885,607 A 5/1975 Peltier
3,938,520 A 2/1976 Scislowicz et al.
3,957,052 A 5/1976 Topham
3,977,555 A 8/1976 Larson
3,993,063 A 11/1976 Larrabee
4,020,839 A 5/1977 Klapp
4,026,128 A 5/1977 Blanco
4,051,852 A 10/1977 Villari
D247,975 S 5/1978 Luther
D248,568 S 7/1978 Ismach
4,109,670 A 8/1978 Slagel
4,121,585 A 10/1978 Becker, Jr.
4,161,178 A 7/1979 Genese
4,187,848 A 2/1980 Taylor
D254,444 S 3/1980 Levine
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley et al.
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
D270,282 S 8/1983 Gross
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustavsson
4,573,993 A 3/1986 Hoag et al.
4,576,211 A 3/1986 Valentini et al.
4,581,014 A 4/1986 Millerd et al.
4,585,446 A 4/1986 Kempf
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,675,020 A 6/1987 McPhee
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
D300,060 S 2/1989 Molgaard-Nielsen
4,804,366 A 2/1989 Zdeb et al.
4,826,492 A 5/1989 Magasi
4,832,690 A 5/1989 Kuu
4,834,152 A 5/1989 Howson et al.
D303,013 S 8/1989 Konopka
4,857,062 A 8/1989 Russell
4,865,592 A 9/1989 Rycroft
4,871,463 A 10/1989 Taylor et al.
4,898,209 A 2/1990 Zbed
4,909,290 A 3/1990 Coccia
4,919,596 A 4/1990 Slate et al.
4,927,423 A 5/1990 Malmborg
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van der Heiden et al.
5,006,114 A 4/1991 Rogers et al.
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco
5,088,996 A 2/1992 Kopfer et al.
5,096,575 A 3/1992 Cosack
5,104,387 A 4/1992 Pokorney et al.
5,113,904 A 5/1992 Aslanian
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.
5,232,109 A 8/1993 Tirrell et al.

(56) References Cited

U.S. PATENT DOCUMENTS 5,242,432 A 9/1993 Defrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,304,165 A 4/1994 Haber et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.

(56) References Cited

U.S. PATENT DOCUMENTS

D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,186,997 B1 2/2001 Gabbard et al.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 * 11/2002 Aneas ..... A61J 1/2089 215/247
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann

(56) References Cited

U.S. PATENT DOCUMENTS

D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
7,611,487 B2 11/2009 Woehr et al.
7,611,502 B2 11/2009 Daly
7,615,041 B2 11/2009 Sullivan et al.
7,628,779 B2 12/2009 Aneas
7,632,261 B2 12/2009 Zinger et al.
D608,900 S 1/2010 Giraud et al.
7,654,995 B2 2/2010 Warren et al.
7,670,326 B2 3/2010 Shemesh
7,695,445 B2 4/2010 Yuki
7,704,229 B2 4/2010 Moberg et al.
D616,090 S 5/2010 Kawamura
7,713,247 B2 5/2010 Lopez
7,717,886 B2 5/2010 Lopez
7,722,090 B2 5/2010 Burton et al.
D616,984 S 6/2010 Gilboa
7,731,678 B2 6/2010 Tennican et al.
7,743,799 B2 6/2010 Mosler et al.
7,744,581 B2 6/2010 Wallen et al.
7,757,901 B2 7/2010 Welp
7,758,082 B2 7/2010 Weigel et al.
7,758,560 B2 7/2010 Connell et al.
7,762,524 B2 7/2010 Cawthon et al.
7,766,304 B2 8/2010 Phillips
7,771,383 B2 8/2010 Truitt et al.
D624,641 S 9/2010 Boclet
7,799,009 B2 9/2010 Niedospial, Jr. et al.
7,803,140 B2 9/2010 Fangrow, Jr.
D627,216 S 11/2010 Fulginiti
D630,732 S 1/2011 Lev et al.
7,862,537 B2 1/2011 Zinger et al.
7,867,215 B2 1/2011 Akerlund et al.
7,879,018 B2 2/2011 Zinger et al.
7,883,499 B2 2/2011 Fangrow
7,895,216 B2 2/2011 Longshaw et al.
D634,007 S 3/2011 Zinger et al.
7,900,659 B2 3/2011 Whitley et al.
D637,713 S 5/2011 Nord et al.
7,963,954 B2 6/2011 Kavazov
D641,080 S 7/2011 Zinger et al.
7,985,216 B2 7/2011 Daily et al.
D644,104 S 8/2011 Maeda et al.
3,007,461 A1 8/2011 Huo et al.
7,993,328 B2 8/2011 Whitley
8,012,132 B2 9/2011 Lum et al.
8,016,809 B2 9/2011 Zinger et al.
8,021,325 B2 9/2011 Zinger et al.
8,025,653 B2 9/2011 Capitaine et al.
8,025,683 B2 9/2011 Morrison
8,029,472 B2 10/2011 Leinsing et al.
8,038,123 B2 10/2011 Ruschke et al.
3,066,688 A1 11/2011 Zinger et al.
8,070,739 B2 12/2011 Zinger et al.
8,075,550 B2 12/2011 Nord et al.
8,096,525 B2 1/2012 Ryan
8,105,314 B2 1/2012 Fangrow, Jr.
D654,166 S 2/2012 Lair
D655,017 S 2/2012 Mosler et al.
8,122,923 B2 2/2012 Kraus et al.
8,123,736 B2 2/2012 Kraushaar et al.
D655,071 S 3/2012 Davila
D657,461 S 4/2012 Schembre et al.
8,152,779 B2 4/2012 Cabiri
8,157,784 B2 4/2012 Rogers
8,167,863 B2 5/2012 Yow
8,172,824 B2 5/2012 Pfeifer et al.
8,177,768 B2 5/2012 Leinsing
8,182,452 B2 5/2012 Mansour et al.
8,187,248 B2 5/2012 Zihlmann
8,196,614 B2 6/2012 Kriheli
8,197,459 B2 6/2012 Jansen et al.
8,211,069 B2 7/2012 Fangrow, Jr.
8,225,959 B2 7/2012 Lambrecht
8,241,268 B2 8/2012 Whitley
8,262,628 B2 9/2012 Fangrow, Jr.
8,262,641 B2 9/2012 Vedrine et al.
8,267,127 B2 9/2012 Kriheli
D669,980 S 10/2012 Lev et al.
8,287,513 B2 10/2012 Ellstrom et al.
8,328,784 B2 12/2012 Jensen et al.
D673,673 S 1/2013 Wang
D674,084 S 1/2013 Linnenschmidt
D674,088 S 1/2013 Lev et al.
8,348,898 B2 1/2013 Cabiri
D681,230 S 4/2013 Mosler et al.
8,454,573 B2 6/2013 Wyatt et al.
8,469,939 B2 6/2013 Fangrow, Jr.
8,475,404 B2 7/2013 Foshee et al.
8,480,645 B1 7/2013 Choudhury et al.
8,480,646 B2 7/2013 Nord et al.
8,506,548 B2 8/2013 Okiyama
8,511,352 B2 8/2013 Kraus et al.
8,512,309 B2 8/2013 Shemesh et al.
D690,009 S 9/2013 Schembre et al.
D690,418 S 9/2013 Rosenquist
8,523,837 B2 9/2013 Wiggins et al.
8,545,476 B2 10/2013 Ariagno et al.
8,551,067 B2 * 10/2013 Zinger ..... A61J 1/1406 604/403
8,556,879 B2 10/2013 Okiyama
8,562,582 B2 10/2013 Tuckwell et al.
8,608,723 B2 12/2013 Lev et al.
8,628,508 B2 1/2014 Weitzel et al.
8,636,689 B2 1/2014 Halili, Jr. et al.
8,684,992 B2 4/2014 Sullivan et al.
8,684,994 B2 4/2014 Lev et al.
8,752,598 B2 6/2014 Denenburg et al.
D714,935 S 10/2014 Nishioka et al.
D717,406 S 11/2014 Stanley et al.
D717,948 S 11/2014 Strong et al.
D719,650 S 12/2014 Arinobe et al.
D720,067 S 12/2014 Rosenquist
D720,451 S 12/2014 Denenburg et al.
D720,452 S 12/2014 Jordan
8,900,212 B2 12/2014 Kubo
8,905,994 B1 12/2014 Lev et al.
8,915,882 B2 12/2014 Cabiri
D720,850 S 1/2015 Hsia et al.
D732,660 S 6/2015 Ohashi
D732,664 S 6/2015 Woehr et al.
D733,291 S 6/2015 Wang
D733,292 S 6/2015 Rogers
D733,293 S 6/2015 Rogers
9,072,827 B2 7/2015 Cabiri
D738,494 S 9/2015 Kashmirian
D741,457 S 10/2015 Guest
9,149,575 B2 10/2015 Cabiri
D750,235 S 2/2016 Maurice
9,254,242 B2 2/2016 Mueller et al.
D757,933 S 5/2016 Lev et al.
9,339,438 B2 * 5/2016 Lev ..... A61J 1/2089
9,393,365 B2 7/2016 Cabiri
9,414,991 B2 * 8/2016 Sanders ..... A61M 39/1011
9,486,391 B2 11/2016 Shemesh
9,492,610 B2 11/2016 Cabiri
9,511,190 B2 12/2016 Cabiri
9,522,234 B2 12/2016 Cabiri
D794,183 S 8/2017 Lev et al.

(56) References Cited

U.S. PATENT DOCUMENTS 9,763,855 B2 9/2017 Fangrow
9,801,786 B2 * 10/2017 Lev ..... A61J 1/2089
10,206,854 B2 2/2019 Wu et al.
10,376,654 B2 * 8/2019 Sanders ..... A61J 1/1406
2001/0000347 A1 4/2001 Hellstrom et al.
2001/0025671 A1 10/2001 Safabash
2001/0029360 A1 10/2001 Miyoshi et al.
2001/0051793 A1 12/2001 Weston
2002/0017328 A1 2/2002 Loo
2002/0055711 A1 5/2002 Lavi et al.
2002/0065488 A1 5/2002 Suzuki et al.
2002/0066715 A1 6/2002 Niedospial
2002/0087118 A1 7/2002 Reynolds et al.
2002/0087141 A1 7/2002 Zinger et al.
2002/0087144 A1 7/2002 Zinger et al.
2002/0104584 A1 8/2002 Spero et al.
2002/0115980 A1 8/2002 Niedospial et al.
2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds
2003/0109846 A1 6/2003 Zinger et al.
2003/0120209 A1 6/2003 Jensen et al.
2003/0135159 A1 7/2003 Daily et al.
2003/0153895 A1 8/2003 Leinsing
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1 10/2003 Fowles et al.
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0132851 A1 * 6/2008 Shaw ..... A61M 5/31
604/199
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim
2008/0215015 A1 9/2008 Cindrich et al.
2008/0249473 A1 10/2008 Ruth et al.
2008/0249479 A1 10/2008 Zinger et al.
2008/0249498 A1 10/2008 Fangrow
2008/0262465 A1 10/2008 Zinger et al.
2008/0269687 A1 10/2008 Chong
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger

(56) References Cited

U.S. PATENT DOCUMENTS

2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsals
2010/0152658 A1 6/2010 Hanson et al.
2010/0160889 A1 6/2010 Smith et al.
2010/0162548 A1 7/2010 Leidig
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1 4/2011 Mosler et al.
2011/0125056 A1 5/2011 Merchant
2011/0144584 A1 6/2011 Wozencroft
2011/0160655 A1 6/2011 Hanson et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022344 A1 1/2012 Kube
2012/0022469 A1 1/2012 Alpert
2012/0053555 A1 3/2012 Ariagno et al.
2012/0059332 A1 3/2012 Woehr et al.
2012/0059346 A1 3/2012 Sheppard et al.
2012/0067429 A1 3/2012 Mosler et al.
2012/0071819 A1 3/2012 Bruggemann et al.
2012/0078214 A1 3/2012 Finke et al.
2012/0123382 A1 5/2012 Kubo
2012/0184938 A1 7/2012 Lev et al.
2012/0215182 A1 8/2012 Mansour et al.
2012/0220977 A1 8/2012 Yow
2012/0220978 A1 8/2012 Lev et al.
2012/0265163 A1 10/2012 Cheng et al.
2012/0271229 A1 10/2012 Lev et al.
2012/0296307 A1 11/2012 Holt et al.
2012/0310203 A1 12/2012 Khaled et al.
2012/0323172 A1 12/2012 Lev et al.
2012/0323187 A1 12/2012 Iwase et al.
2012/0323210 A1 12/2012 Lev et al.
2013/0046269 A1 2/2013 Lev et al.
2013/0053814 A1 2/2013 Mueller-Beckhaus et al.
2013/0096493 A1 4/2013 Kubo et al.
2013/0110049 A1 5/2013 Cronenberg et al.
2013/0144248 A1 6/2013 Putter et al.
2013/0199669 A1 8/2013 Moy et al.
2013/0226100 A1 8/2013 Lev
2013/0231630 A1 9/2013 Kraus et al.
2013/0237904 A1 9/2013 Deneburg et al.
2013/0253448 A1 9/2013 Baron et al.
2013/0289530 A1 10/2013 Wyatt et al.
2014/0020793 A1 1/2014 Denenburg et al.
2014/0096862 A1 4/2014 Aneas
2014/0150911 A1 6/2014 Hanner et al.
2014/0194854 A1 7/2014 Tsals
2014/0221940 A1 8/2014 Clauson et al.
2014/0277052 A1 9/2014 Haselby et al.
2014/0352845 A1 12/2014 Lev et al.
2015/0082746 A1 3/2015 Ivosevic et al.
2015/0088078 A1 3/2015 Lev et al.
2015/0112297 A1 4/2015 Lev et al.
2015/0290390 A1 10/2015 Ring et al.
2015/0297839 A1* 10/2015 Sanders ..... A61J 1/2096
604/241
2015/0305770 A1 10/2015 Fill et al.
2016/0088995 A1 3/2016 Ueda et al.
2016/0166824 A1* 6/2016 Lev ..... A61J 1/1481
604/411
2016/0199569 A1 7/2016 Yevmenenko et al.
2016/0228644 A1 8/2016 Cabiri
2016/0287475 A1 10/2016 Yevmenenko et al.
2016/0367439 A1 12/2016 Davis et al.
2019/0133885 A1 5/2019 Wu et al.

FOREIGN PATENT DOCUMENTS

CN 1636605 A 7/2005
CN 1747683 A 3/2006
CN 1863566 A 11/2006
CN 1950049 A 4/2007
CN 101001661 A 7/2007
CN 101687083 A 3/2010
DE 1064693 B 9/1959
DE 1913926 A1 9/1970
DE 4122476 A1 1/1993
DE 4408498 A1 5/1995
DE 19504413 A1 8/1996
DE 202004012714 U1 11/2004
DE 102007046951 B3 2/2009
DE 202009011019 U1 12/2010
EM 000627237-0001 1/2007
EM 001680703-0002 3/2010
EP 0192661 A1 9/1986
EP 0195018 A1 9/1986
EP 0258913 A2 3/1988
EP 0416454 A2 3/1991
EP 0426403 A1 5/1991
EP 0282545 B1 2/1992
EP 0518397 A1 12/1992
EP 0521460 A1 1/1993
EP 582038 A2 2/1994
EP 0598918 A1 6/1994
EP 0637443 A1 2/1995
EP 761562 A1 3/1997
EP 765652 A1 4/1997
EP 765853 A1 4/1997
EP 0806597 A1 11/1997
EP 0814866 A1 1/1998
EP 829248 A2 3/1998
EP 0856331 A2 8/1998
EP 882441 A2 12/1998
EP 0887085 A2 12/1998
EP 0887885 A2 12/1998
EP 897708 A2 2/1999
EP 0898951 A2 3/1999
EP 960616 A2 12/1999
EP 1008337 A1 6/2000
EP 1029526 A1 8/2000
EP 1034809 A1 9/2000
EP 1051988 A2 11/2000
EP 1323403 A1 7/2003
EP 1329210 A1 7/2003
EP 1396250 A1 3/2004
EP 1454609 A1 9/2004
EP 1454650 A1 9/2004

(56) References Cited

FOREIGN PATENT DOCUMENTS

| | | | |
|---|---|---|---|
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| IL | 186290 | | 1/2008 |
| JP | 03-062426 | B | 9/1991 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | | 5/1998 |
| JP | H10-504736 | A | 5/1998 |
| JP | 11503627 | | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 4329954 | B2 | 9/2009 |
| JP | 2010063622 | A | 3/2010 |
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9513785 | A1 | 5/1995 |
| WO | 9600053 | A1 | 1/1996 |
| WO | 9609083 | A1 | 3/1996 |
| WO | 9629113 | A1 | 9/1996 |
| WO | 0737467 | A1 | 10/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2004096113 | A2 | 11/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007/105221 | A1 | 9/2007 |
| WO | 2007101772 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011/004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012/004790 | A2 | 1/2012 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014099395 | A1 | 6/2014 |
| WO | 2014170888 | | 10/2014 |
| WO | 2014170888 | A1 | 10/2014 |
| WO | 2014174278 | A1 | 10/2014 |
| WO | 2016023590 | A1 | 2/2016 |

OTHER PUBLICATIONS

Novel Transfer, Mixing and Drug Delivery Systems, MOP Medimop Medical Projects Ltd. Catalog, 4 pages, Rev. 4, 2004. cited by other.

Smart Site.RTM. Alaris Medical Systems Product Brochure, 4 pages, Issue 1, Oct. 1999. cited by other.

MixJect, downloaded from webpage: http://www.westpharma.com/en/products/Pages/Mixject.aspx, Download Date: Aug. 8, 2012, 1 page.

MixJet Product Information Sheet, downloaded from webpage: http://www.westpharma.com/SiteCollectionDocuments/Recon/mixject%20product%20sheet.pdf; 1 page.

Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.

Kipp, "Plastic Material Data Sheets," retrieved from the Internet: http://www.knovel.com/web/portal/browse/display?_EXT_KNOVEL_DISPLAY_bookid=1023&VerticalID=0, retrieved on Feb. 9, 2011.

Alaris Medical Systems Product Brochure, 4 pages, Issue 1, Oct. 11, 1999.

Smart Site Needle-Free Systems, Alaris Medical Systems Webpage, 4 pages, Feb. 2006.

Photographs of Alaris Medical Systems SmartSite.RTM. device, 5 pages, 2002.

(56) References Cited

OTHER PUBLICATIONS

Non-Vented Vial Access Pin with ULTRASITE.RTM. Valve, B. Braun Medical, Inc. website and product description, 3 pages, Feb. 2006.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages. see pp. 5-6).
West, Vial2Bag DC system, Oct. 2, 2014, https://web.archive.org/web/20141002065133/http://www.westpharma.com/en/products/Pages/Reconstitutionsystems.aspx.
Vial2Bag DC, downloaded from webpage: https://www.youtube.com/watch?v=FEOkg1xNBrs, Original posting date: Aug. 21, 2014, 1 page.
Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.
Int'l Preliminary Report on Patentability dated Feb. 26, 2019 in Int'l Application No. PCT/ IL2017/051308.
Summit International Medical Technologies Inc., Vial Direct to Bag Spike 2020.
Merchant "An engineered control device for needle free reconstitution and transfer of compounded sterile intravenous drug solutions for immediate use to assist in complying with United States Pharmacopeia Chapter <797> standard", Adv Care, 2 pages, 2018.

* cited by examiner

FIG. 3
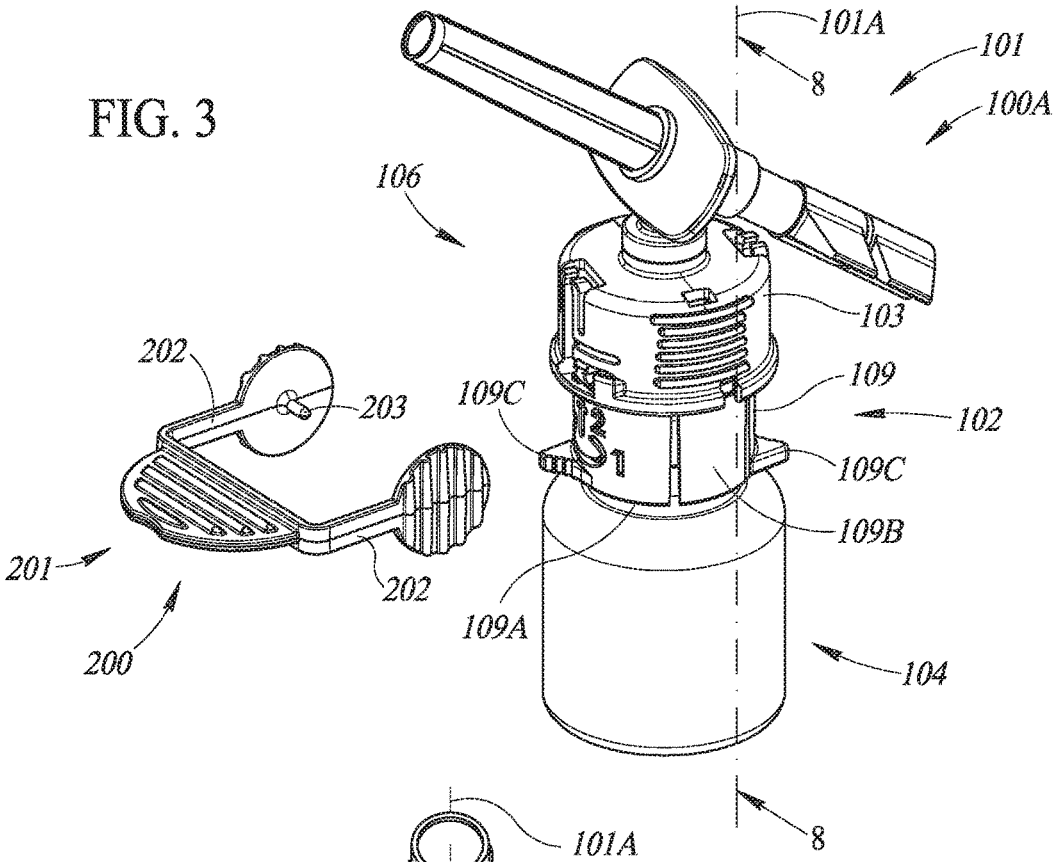
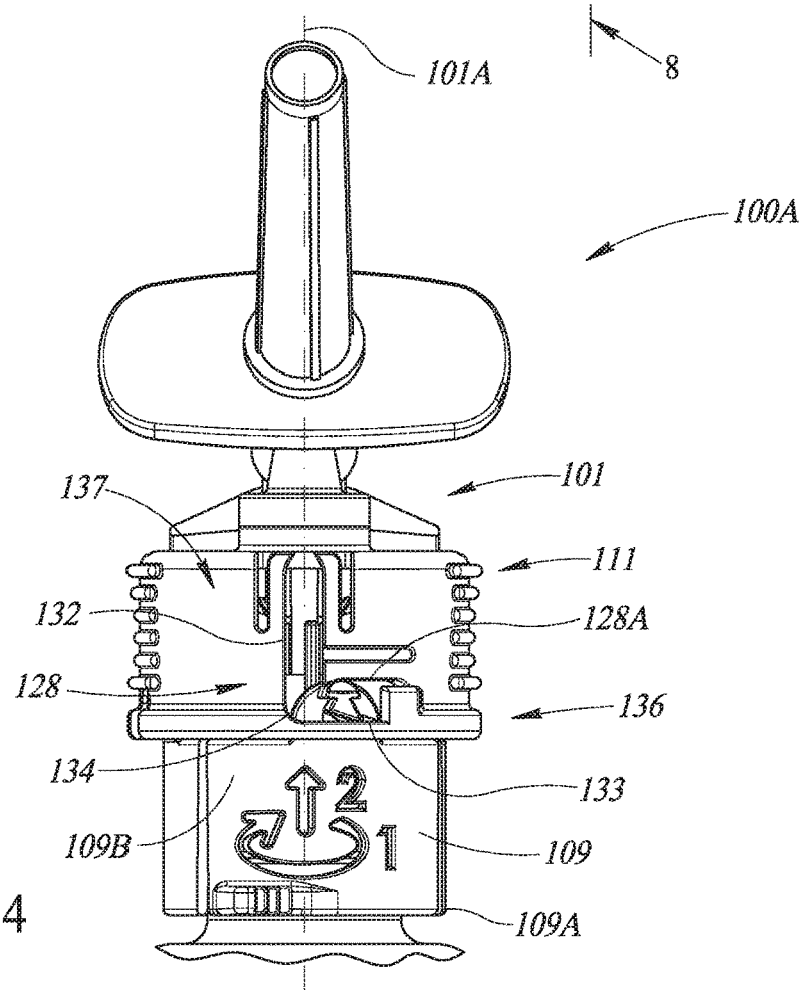
FIG. 4

LIQUID TRANSFER DEVICE WITH INTEGRAL TELESCOPIC VIAL ADAPTER FOR USE WITH INFUSION LIQUID CONTAINER AND DISCRETE INJECTION VIAL

CROSS-REFERENCE TO RELATED APPLICATION

This application is a Section 371 of International Application No. PCT/IL/2017/051308, filed Nov. 30, 2017, which was published in the English language on Jun. 14, 2018 under International Publication No. WO 2018/104932 A1, and claims priority to Israeli Application No. 249408, filed Dec. 6, 2016, the disclosures of which are incorporated herein by reference in their entirety.

FIELD OF THE INVENTION

The invention relates to medical devices in general and liquid transfer devices for use with infusion liquid containers and discrete injection vials in particular.

BACKGROUND OF THE INVENTION

Commonly owned WIPO International Application No. PCT/IL2014/050680 entitled Liquid Transfer Devices for Use with Infusion Liquid Containers and published under WIPO International Publication No. WO 2015/019343 discloses liquid transfer devices for use with an infusion liquid container and a discrete injection vial for assisting preparation of an infusion liquid container with a medicated infusion liquid for administration to a patient. The infusion liquid containers can be in the form of an infusion bag, an infusion bottle, and the like. The infusion liquid containers contain an infusion liquid and have an intravenous (IV) or administration port. WO 2015/019343's FIG. 4 and FIG. 5 show a liquid transfer device hereinafter referred to as the WO 2015/019343 liquid transfer device, WO 2015/019343's FIG. 6 shows another liquid transfer device and WO 2015/019343's FIG. 7 shows yet another liquid transfer device.

The WO 2015/019343 liquid transfer device includes a trifurcated connector body having an IV spike for sealing insertion into an IV port, a vial adapter port with an integral vial adapter for snap fit telescopic mounting on a discrete injection vial for flow communication therewith, and a twist-off substitute IV port. The twist-off substitute IV port includes a septum which is initially sealed prior to being punctured on insertion of an IV spike of an infusion set. The bifurcated body has three lumens for the IV spike, the vial adapter port and the twist-off substitute IV port. The three lumens are in 3 way direct and continuous fluid connection such that preparation of an infusion liquid container with a medicated infusion liquid includes the following steps:

Step 1 snap fit telescopic mounting a liquid transfer device's vial adapter onto a discrete injection vial.

Step 2 inserting the liquid transfer device's IV spike into an infusion liquid container's IV port for establishing an immediate flow path between the infusion liquid container and the discrete injection vial.

Step 3 repeated forward and backward transfer of liquid contents from the infusion liquid container to the discrete injection vial to mix or reconstitute the injection vial's medicament to form medicated infusion liquid in the infusion liquid container.

Step 4 opening the liquid transfer device's substitute IV port and inserting an infusion set's IV spike thereinto for establishing immediate flow path between the infusion liquid container and the infusion set ready for gravitational flow of medicated infusion liquid from the infusion liquid container to a patient.

In some medical institutions, Step 1 to Step 4 are performed in quick succession adjacent a patient immediately before administration notwithstanding a healthcare provider having gloved hands has to be dexterous to handle a liquid transfer device and a discrete injection vial. In other medical institutions, such bedside preparation is regarded as inconvenient and problematic and prefer Step 1 to Step 3 be performed beforehand and only Step 4 be performed adjacent a patient immediately before administration. But such early preparation of a medicated infusion liquid inherently leads to a delay between preparation and administration with a possible detrimental effect to a medicated infusion liquid.

There is a need to facilitate administration of medicated infusion liquids.

SUMMARY OF THE INVENTION

The present invention is directed towards liquid transfer devices similar to the aforementioned WO 2015/019343 liquid transfer device. The liquid transfer devices of the present invention differ from the former as follows: First, the liquid transfer devices include an integral telescopic vial adapter for snap fit telescopic mounting on a discrete injection vial but leaving it intact insofar as its injection vial stopper remains non-punctured until a subsequent compaction. Second, the integral telescopic vial adapter includes a safety catch mechanism for precluding its advertent compaction from a pre-compacted state to a compacted state. The safety catch mechanism requires a user release action to release same. User release actions can include inter alia a twist action, a pull action, removal of a safety catch, and the like. And third, the integral telescopic vial adapter includes a clamping arrangement for irreversibly clamping same in its compacted state. The liquid transfer devices of the present invention are not limited to a twist-off substitute IV port but can be equally fitted with, for example, a substitute IV port requiring the breaking of a frangible component for opening the substitute IV port for insertion of an infusion set's IV spike thereinto.

The liquid transfer devices preferably enable a non-punctured intact discrete injection vial to be readily detached from an integral telescopic vial adapter after snap fit telescopic mounting before user compaction for puncturing its injection vial stopper. Such detachment can prevent wastage of injection vials which might otherwise occur in case of early preparation of a medicated infusion liquid and a subsequent decision that the medicated infusion liquid is no longer required to be administered to a patient. Such detachment is preferably achieved by a pincers-like compression. The pincers-like compression is effected by an intact discrete injection vial release tool having an opposite pair of inward directed protrusions. The intact discrete injection vial release tool can be configured as a pincers-like hand tool or a user-operated electromechanical apparatus. The use of an intact discrete injection vial release tool to detach non-punctured intact discrete injection vials as opposed to manual detachment enables only authorized healthcare providers to detach same.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which:

FIG. 3 is a front perspective view of a liquid transfer device including an integral telescopic vial adapter having a twist release safety catch mechanism in a pre-compacted state for mounting on a discrete injection vial and a pincers-like hand tool for releasing a non-punctured intact discrete injection vial from the liquid transfer device;

FIG. 4 is a front elevation view of the FIG. 3 liquid transfer device;

DETAILED DESCRIPTION OF PREFERRED EMBODIMENT OF THE INVENTION

Figure 1:
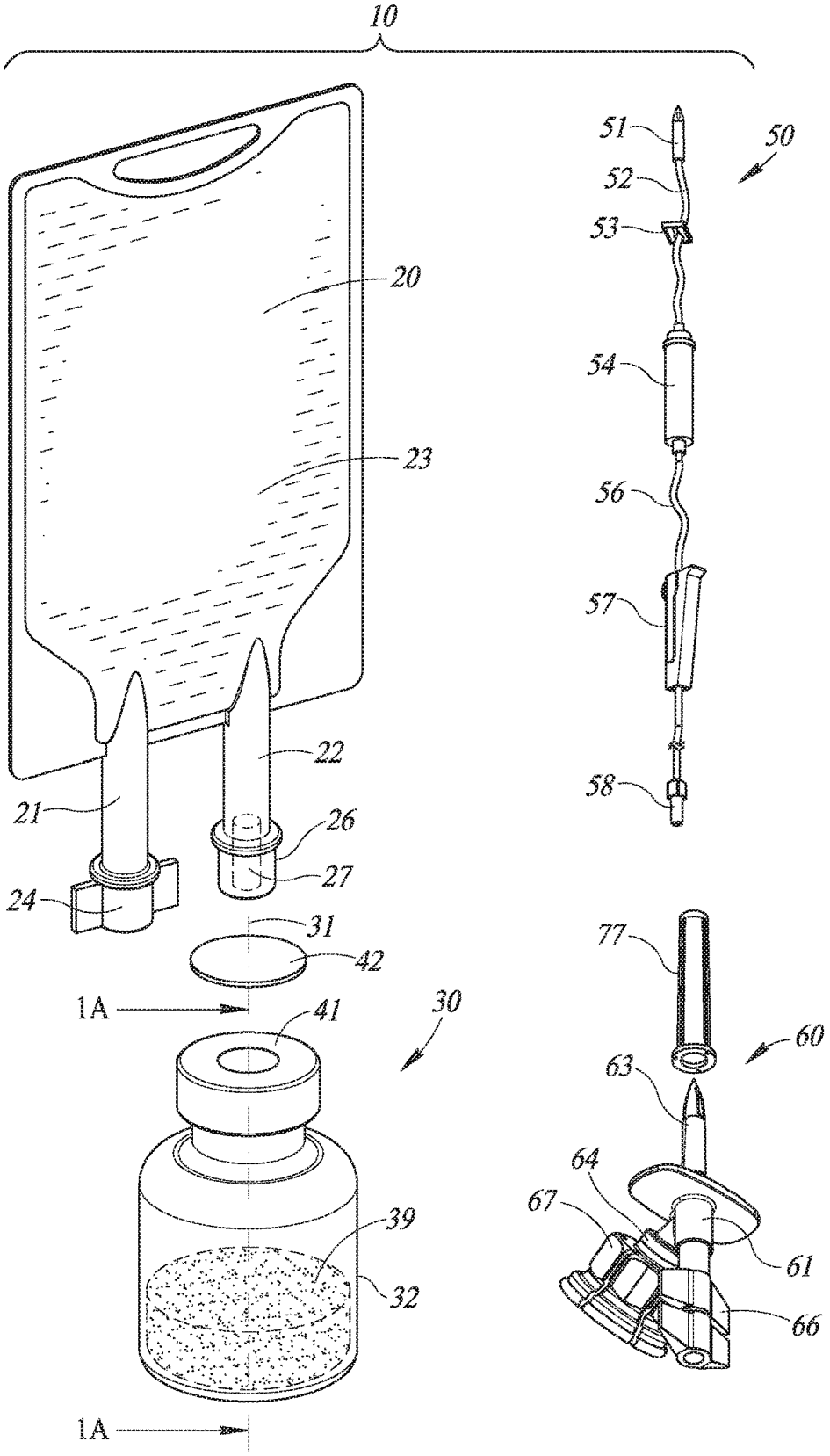
FIG. 1 (PRIOR ART)
FIG. 1 is a pictorial view of a conventional administration set including an infusion bag, the WO 2015/019343 liquid transfer device, a discrete injection vial, and an infusion set.

FIG. 1 shows an administration set 10 including an infusion liquid container 20, an initially non-punctured intact discrete injection vial 30, an infusion set 50, and a WO 2015/019343 liquid transfer device 60. The infusion liquid container 20 is constituted by an intravenous (IV) bag having an IV or administration port 21 and an injection port 22 and containing an infusion liquid 23. The IV port 21 is sealed by a twist-off cap 24 for insertion of an IV spike for administration purposes. The injection port 22 terminates in an injection port tip 26 with a seal-sealing plug 27 intended for needle insertion of syringe contents into the IV bag 20.

Figure 1A:
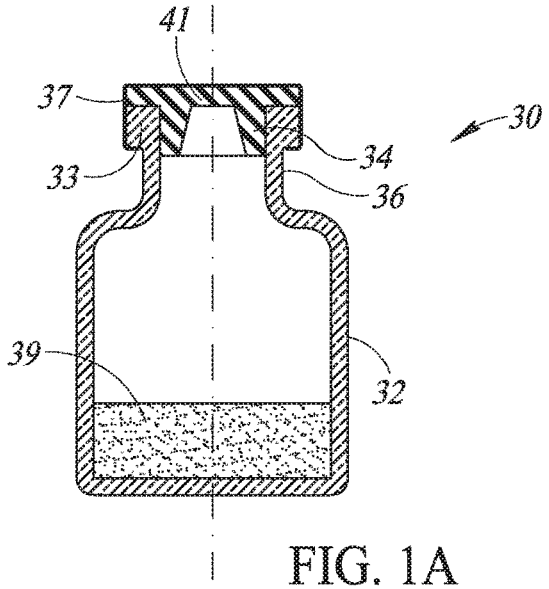
FIG. 1A (PRIOR ART)
FIG. 1A is a longitudinal cross section of the discrete injection vial along a cross section line 1A-1A in FIG. 1.

FIG. 1A shows the discrete injection vial 30 has a longitudinal injection vial centerline 31 and includes a closed end vial tube 32, a tubular vial crown 33 having a crown opening 34 and a vial neck 36 intermediate the vial tube 32 and the vial crown 33. The injection vial 30 includes an injection vial stopper 37 for hermetically sealing the crown opening 34. The vial crown 33 is capped by a band 38. The injection vial 30 contains a medicament 39 for introduction into the infusion liquid 23 to form a medicated infusion liquid. The medicament 39 can be in solid form, powder form or liquid form. The injection vial 30 has an uppermost injection vial surface 41 which is sterilized before accessing the injection vial 30 for forming a medicated infusion liquid. The injection vial 30 includes a flip-off tamper evidence cap 42 which is irreplaceably removed immediately before use to expose the uppermost injection vial surface 41. The tamper evidence cap 42 is intended to be single use such that it cannot be replaced after removal.

The infusion set 50 includes an IV spike 51 and additionally includes first tubing 52, a clamp 53, a drip chamber 54, second tubing 56, a roller clamp 57, and a male Luer connector 58.

Figure 2A:
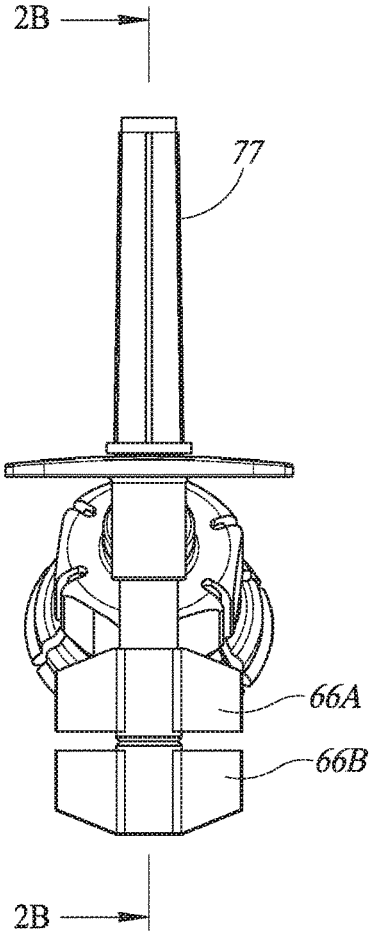
FIG. 2A (PRIOR ART)
FIG. 2A is a top plan view of the WO 2015/019343 liquid transfer device.
Figure 2B:
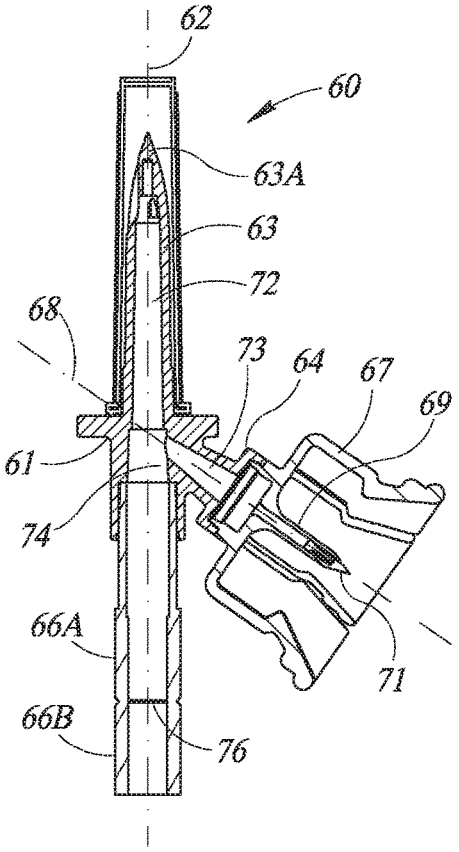
FIG. 2B (PRIOR ART)
FIG. 2B is a longitudinal cross section of the WO 2015/019343 liquid transfer device along a cross section line 2B-2B in FIG. 2A.
Figure 5:
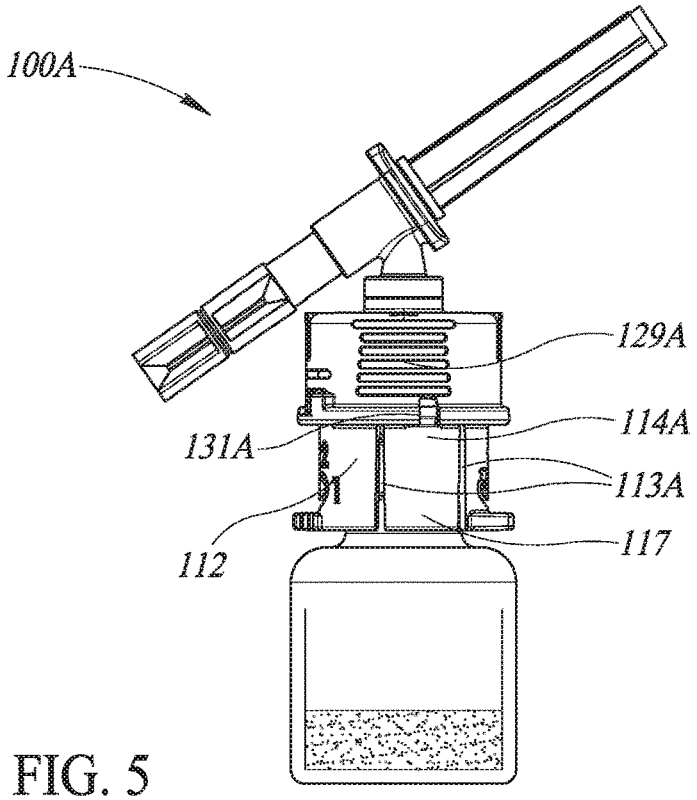
FIG. 5 is a right elevation side view of the FIG. 3 liquid transfer device.
Figure 6:
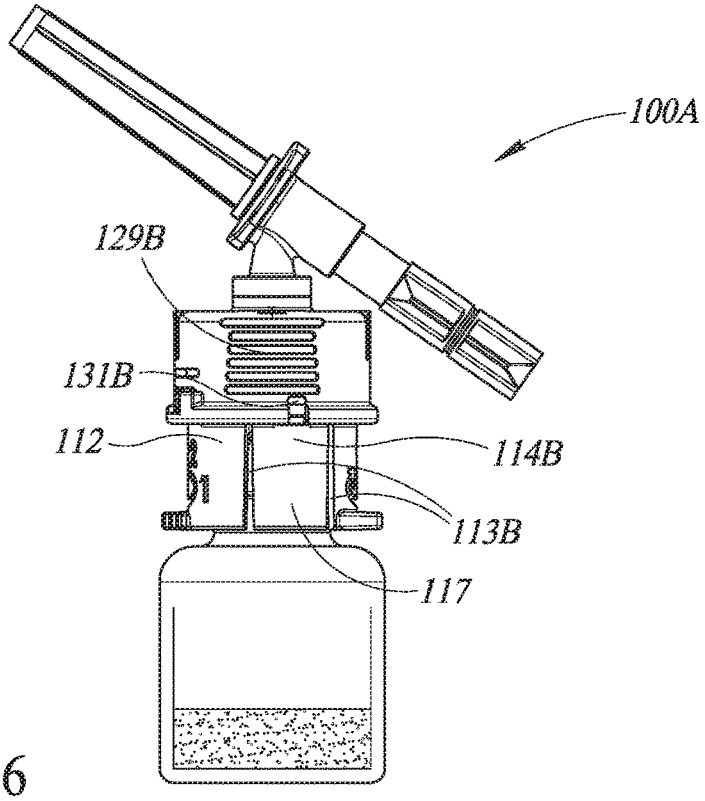
FIG. 6 is a left elevation side view of the FIG. 3 liquid transfer device.
Figure 7:
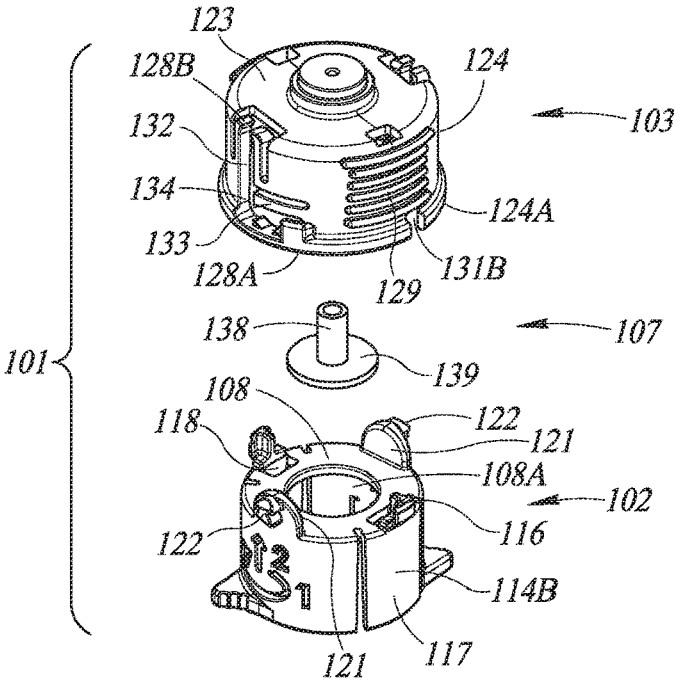
FIG. 7 is an exploded perspective view of the FIG. 3 vial adapter.
Figure 8:
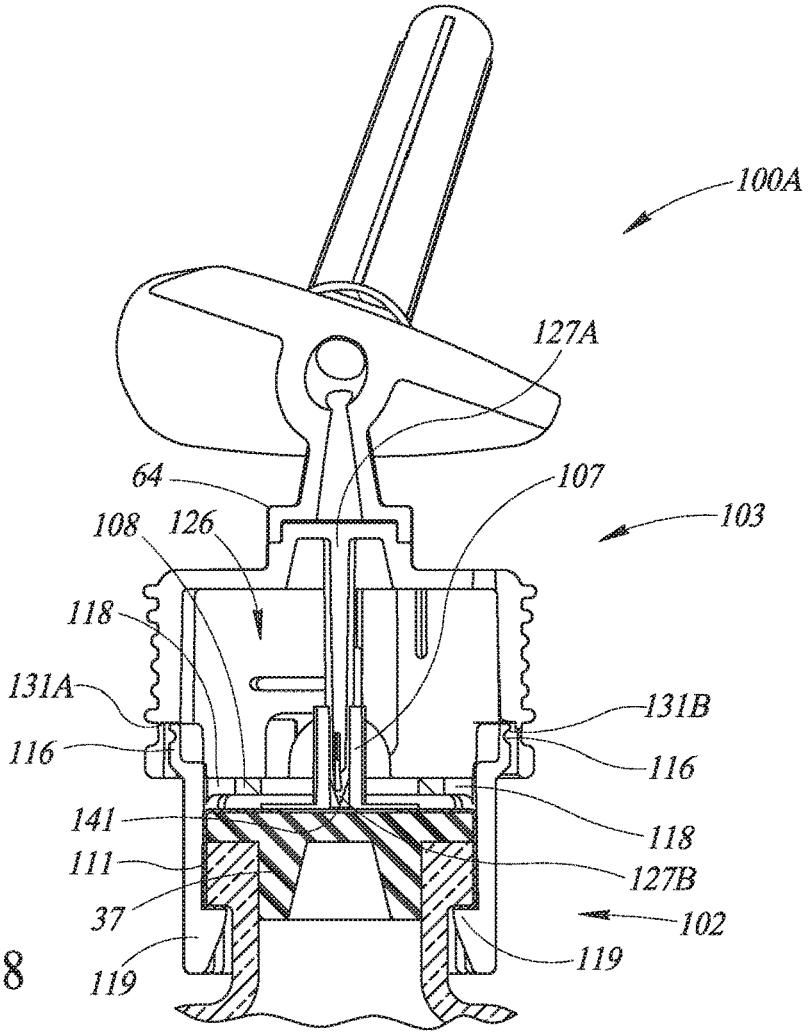
FIG. 8 is a longitudinal cross section of the FIG. 3 liquid transfer device along a cross section line 8-8 in FIG. 3.

FIG. 1, FIG. 2A and FIG. 2B show the WO 2015/019343 liquid transfer device 60 includes a trifurcated Y-shaped connector body 61 having a longitudinal connector body centerline 62, an IV spike 63 for sealing insertion into the IV port 21, a vial adapter port 64, and a twist-off substitute IV port 66. The IV spike 63 has an IV spike tip 63A. The vial adapter port 64 has an integral vial adapter 67 with a vial adapter centerline 68 intercepting the longitudinal connector body centerline 62. The vial adapter 67 has a puncturing cannula 69 with a puncturing cannula tip 71. The connector body 61 has a lumen 72 terminating at the IV spike 63, a lumen 73 in flow communication with the puncturing cannula 69 and a lumen 74 terminating at the substitute IV port 66. The three lumens 72, 73 and 74 are in three way direct and continuous fluid connection. The substitute IV port 66 is formed from suitable flexible plastic material, for example, PVC, and the like, for sealing receiving the IV spike 51. The substitute IV port 66 includes a septum 76 intended to be punctured on insertion of the IV spike 51. The substitute IV port 66 includes a proximal section 66A and a distal section 66B. In use, the distal section 66B is twisted and broken off from the proximal section 66A thereby exposing the septum 76 for puncturing by the infusion set's IV spike 51. The liquid transfer device 60 can include an IV spike cover 77 to protect the IV spike 63.

FIG. 3 to FIG. 16 show a liquid transfer device 100A having a similar construction and operation as the WO 2015/109343 liquid transfer device 60. FIG. 3 also shows a pincers-like hand tool 200 for releasing a non-punctured intact discrete injection vial 30. The pincers-like hand tool 200 includes a pincers-like body 201 with an opposite pair of jaws 202 each terminating at an inward directed protrusion 203. The opposite pair of jaws 202 can be readily manually urged towards one another for applying a pincers-like compression for releasing a non-punctured intact discrete injection vial 30 as described hereinbelow with reference to FIG. 11 and FIG. 12.

The liquid transfer device 100A differs from the liquid transfer device 60 insofar that it includes an integral telescopic vial adapter 101 with a longitudinal vial adapter centerline 101A and having two part construction: an inner vial adapter body 102 and an outer vial adapter body 103. The integral telescopic vial adapter 101 includes a twist release safety catch mechanism 104 for preventing inadvertent user compaction from a pre-compacted state to a compacted state and a clamping arrangement 106 for irreversibly clamping the integral telescopic vial adapter 101 in its compacted state. The integral telescopic vial adapter 101 additionally includes an inverted T-shaped sealing member 107.

The inner vial adapter body 102 has an inverted cup shape including an uppermost transverse annular inner vial adapter body wall 108 and a downward depending vial crown sleeve 109 with a lowermost vial crown sleeve rim 109A. The inner vial adapter body 102 bounds a vial crown cavity 111 for snugly receiving the vial crown 33 therein on telescopically snap fitting the inner vial adapter body 102 thereon. The uppermost transverse annular inner vial adapter body wall 108 has a center uppermost transverse annular inner vial adapter body wall throughgoing aperture 108A along the longitudinal vial adapter centerline 101A overlying the uppermost injection vial surface 41 on telescopically snap fitting on the discrete injection vial 30.

The vial crown sleeve 109 includes a major vial crown sleeve surround 112 with a first adjacent pair of longitudinal directed slits 113A and a second adjacent pair of longitudinal directed slits 113B for correspondingly forming a diametric pair of vial crown holding members 114A and 114B. The diametric pair of vial crown holding members 114 are pivotal with respect to the major vial crown sleeve surround 112 such that each vial crown holding member 114 has a proximal vial crown holding member section 116 and a distal vial crown holding member section 117. The uppermost transverse annular inner vial adapter body wall 108 preferably has a diametric pair of cutouts 118 inward of the diametric pair of vial crown holding members 114 such that the diametric pair of vial crown holding members 114 pivot on the uppermost transverse annular inner vial adapter wall 108.

The distal vial crown holding member sections 117 are each provided with a radial inward vial crown holding projection 119 towards the lowermost vial crown sleeve rim 109A for snap fitting under the vial crown 33 on telescopically snap fitting the inner vial adapter body 102 on the initially non-punctured intact discrete injection vial 30. Application of a pincers-like compression on the proximal vial crown holding member sections 116 towards the longitudinal vial adapter centerline 101A pivots the vial crown holding members 114A and 114B with respect to the major vial crown sleeve surround 112 thereby distancing the radial inward vial crown holding protrusions 117 from the longitudinal vial adapter centerline 101A.

The uppermost transverse annular inner vial adapter body wall 108 has a diametric pair of upright wings 121A and 121B orthogonal to the diametric pair of vial crown holding members 114A and 114B. The diametric pair of upright wings 121 each have a radial outward projection 122 constituting a component of both the twist release safety catch mechanism 104 and the clamping arrangement 106. The vial crown sleeve 109 has a peripheral vial crown sleeve surface 109B with a diametric pair of user indications for indicating a first user step denoted by a circular arrow labelled 1 and a second user step denoted by an upright arrow labelled 2 for activating the liquid transfer device 100A. The vial crown sleeve 109 has a diametric pair of radial outward finger grips 109C towards the lowermost downward depending vial crown sleeve rim 109A.

The outer vial adapter body 103 has an inverted cup shape including an uppermost transverse outer vial adapter body wall 123 and a downward depending skirt 124 with a lowermost skirt rim 124A. The uppermost transverse outer vial adapter body wall 123 is integral mounted on the vial adapter port 64. The outer vial adapter body 103 bounds an inner vial adapter body cavity 126 for snugly telescopically receiving the inner vial adapter body 102 therein on compacting the integral telescopic vial adapter 101 from a pre-compacted state to a compacted state.

The uppermost transverse outer vial adapter body wall 123 includes a downward depending puncturing cannula 127 with a proximal puncturing cannula opening 127A and a distal puncturing cannula tip 127B. The proximal puncturing cannula opening 127A is in flow communication with the vial adapter port 64 and the distal puncturing cannula tip 127B punctures the injection vial stopper 37 in the compacted state of the liquid transfer device 100A.

The downward depending skirt 124 has a diametric pair of L-shaped tracks 128 co-directional with the longitudinal vial adapter centerline 101A constituting a component of both the twist release safety release mechanism 104 and the clamping arrangement 106. The downward depending skirt 124 includes a diametric pair of anti-slip surfaces 129 generally orthogonal to the diametric pair of L-shaped tracks 128 and the diametric pair of radial outward finger grips 109C in the initial pre-compacted state of the liquid transfer device 101A. The downward depending skirt 124 also has a diametric pair of throughgoing discrete injection vial release apertures 131 for use during the release of the discrete injection vial 30. The discrete injection vial release apertures 131 are disposed beneath the anti-slip surfaces 129 and designed to require the pincers-like hand tool 200 to apply a pincers-like compression for releasing a non-punctured intact injection vial 30 and preclude manual application of the pincers-like compression.

Each L-shaped track 128 includes a major track leg 132 co-directional with the longitudinal vial adapter centerline 101A, a minor track leg 133 transverse to the longitudinal vial adapter centerline 101A and a juncture 134 between its major leg 132 and its minor leg 133. Each L-shaped track 128 has a start track end 128A adjacent the lowermost skirt rim 124A and a finish track end 128B adjacent the uppermost transverse outer vial adapter body wall 123. Each minor track leg 133 has a one-way passage arrangement 136 for irreversibly enabling priming of the liquid transfer device 100A. Each finish track end 128B has a one-way passage arrangement 137 constituting a component of the clamping arrangement 106.

The sealing member 107 has a sealing member tube 138 for mounting on the puncturing cannula 127 and a flat sealing member base 139 disposed in the central uppermost transverse annular inner vial adapter body wall throughgoing aperture 108A in the initial pre-compacted state of the liquid transfer device 100A. The central part of the flat sealing member base 139 acts as a sealing member septum 141 for maintaining sterility of the distal puncturing cannula tip 127B. The flat sealing member base 139 is sealing disposed on the uppermost injection vial surface 41 on telescopic mounting the liquid transfer device 100A on the injection vial 30. The sealing member septum 141 is intended to be punctured by the distal puncturing cannula tip 127B in the compacted state of the liquid transfer device 100A.

The use of the liquid transfer device 100A is now described with reference to FIG. 9 to FIG. 16.

Figure 10:
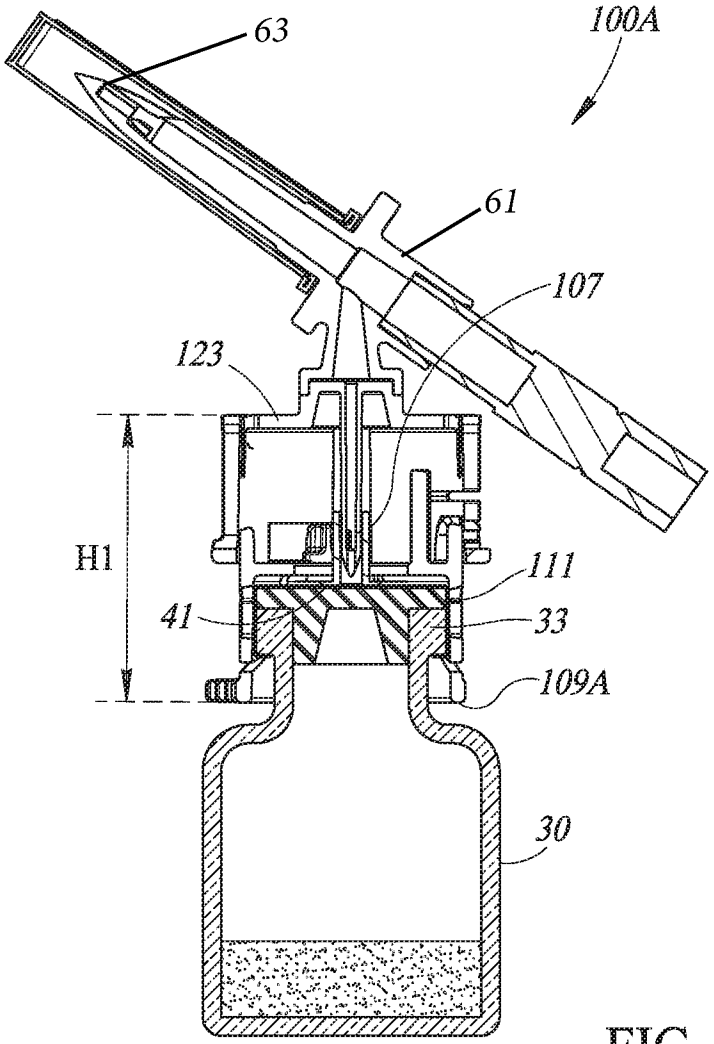
FIG. 10 is a longitudinal cross section of the FIG. 3 liquid transfer device mounted on the discrete injection vial along a cross section line 10-10 in FIG. 9.
Figure 9:
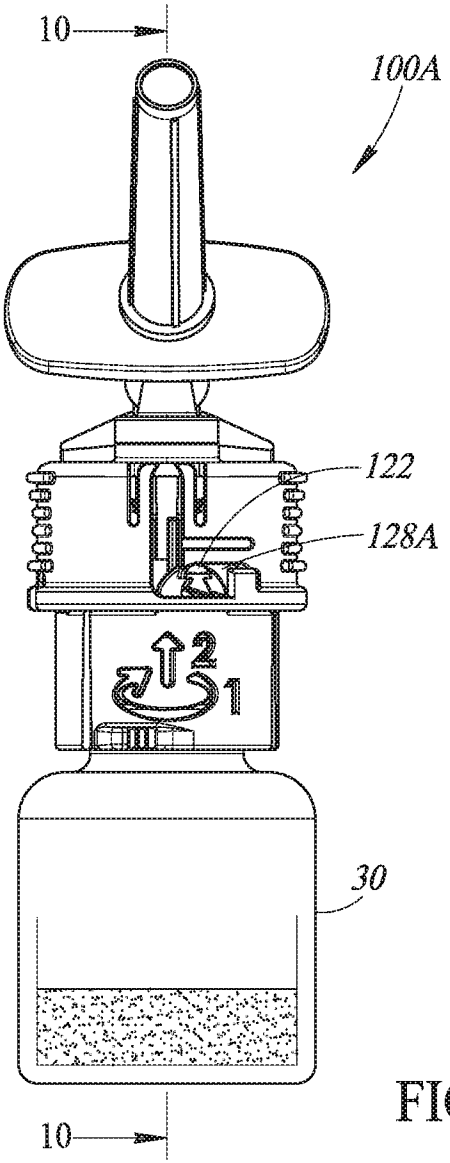
FIG. 9 is a front elevation view of the FIG. 3 liquid transfer device in an initial pre-compacted state mounted on the discrete injection vial.

FIG. 9 and FIG. 10 show the liquid transfer device 100A in an initial pre-compacted state mounted on the discrete injection vial 30. The vial crown cavity 111 snugly receives the vial crown 33. The radial outward projections 122 are disposed at the start track ends 128A. The sealing member base 139 is sealingly disposed on the uppermost injection vial surface 41 after removal of the tamper evidence cap 42. The proximal vial crown holding member sections 116 are disposed at the discrete injection vial release apertures 131. The integral telescopic vial adapter 101 has a pre-compacted height H1 between the uppermost transverse outer vial adapter body wall 123 and the lowermost vial crown sleeve rim 109A.

Figure 12:
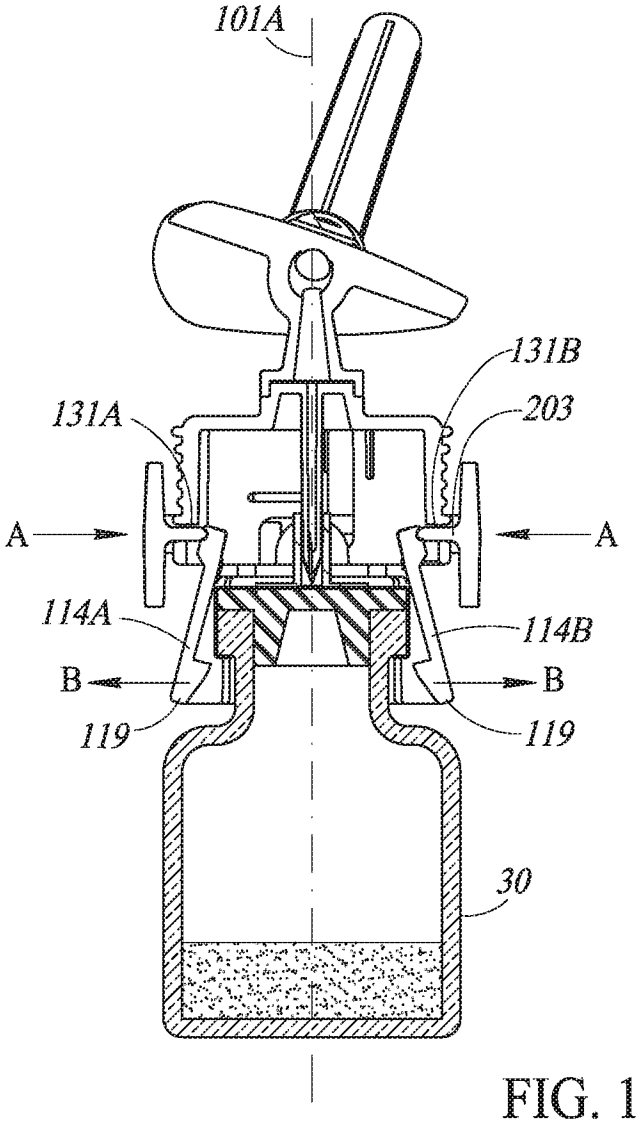
FIG. 12 is a longitudinal cross section of the FIG. 3 liquid transfer device along a cross section line 12-12 in FIG. 11.
Figure 11:
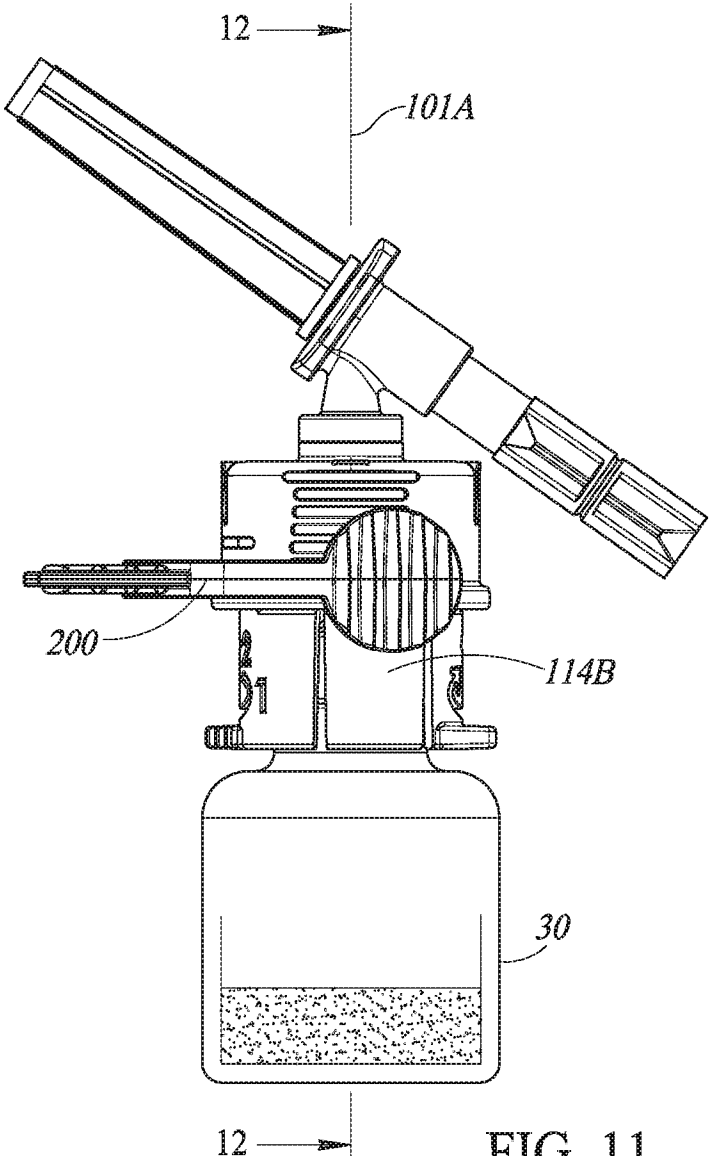
FIG. 11 is a left elevation side view showing the use of the pincers-like hand tool in the pre-compacted state for releasing the non-punctured intact discrete injection vial from the FIG. 3 liquid transfer device.

In the event it is decided not to administer the medicament and re-use the non-punctured intact discrete injection vial 30, a healthcare provider takes the following steps as shown in FIG. 11 and FIG. 12: the healthcare provider aligns the pincers-like hand tool 200 with the integral telescopic vial adapter 101 for inserting the opposite pair of inward directed protrusions 203 through the diametric pair of discrete injection vial release apertures 131. The healthcare provider applies a pincers-like compression on the proximal vial crown holding member sections 116 for urging them towards the longitudinal vial adapter centerline 101A as denoted by arrows A. The diametric pair of vial crown holding members 114 pivot with respect to the major vial crown sleeve surround 112 thereby distancing the diametric pair of radial inward vial crown holding projections 119 away from the longitudinal vial adapter centerline 101A as denoted by arrows B to release the non-punctured intact discrete injection vial 30. The healthcare provider withdraws the non-punctured intact discrete injection vial 30 from the inner vial adapter body 102 as denoted by arrow C for subsequent use and discards the liquid transfer device 100A. The discrete injection vial 30 is still regarded as being intact notwithstanding that its flip-off tamper evidence cap 42 has been removed and isn't replaceable. The discrete injection vial 30 is intact in the sense that its injection vial stopper 37 has not been punctured therethrough for establishing flow communication with its vial tube 32.

Figure 14:
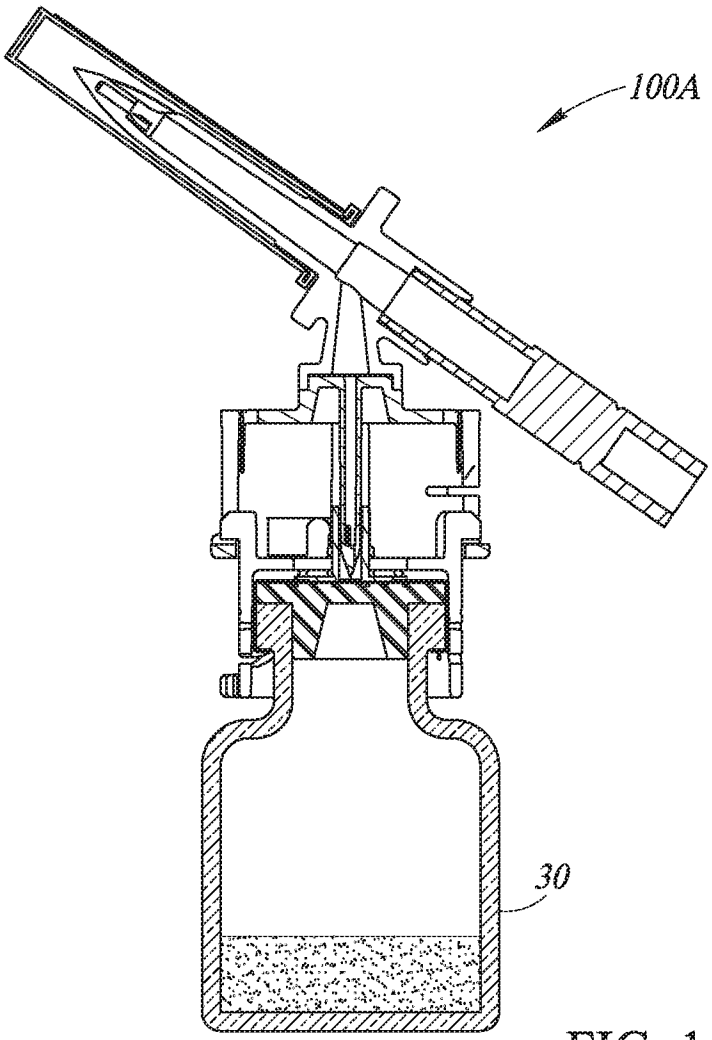
FIG. 14 is a longitudinal cross section of the FIG. 3 liquid transfer device mounted on the discrete injection vial along a cross section line 14-14 in FIG. 13.
Figure 13:
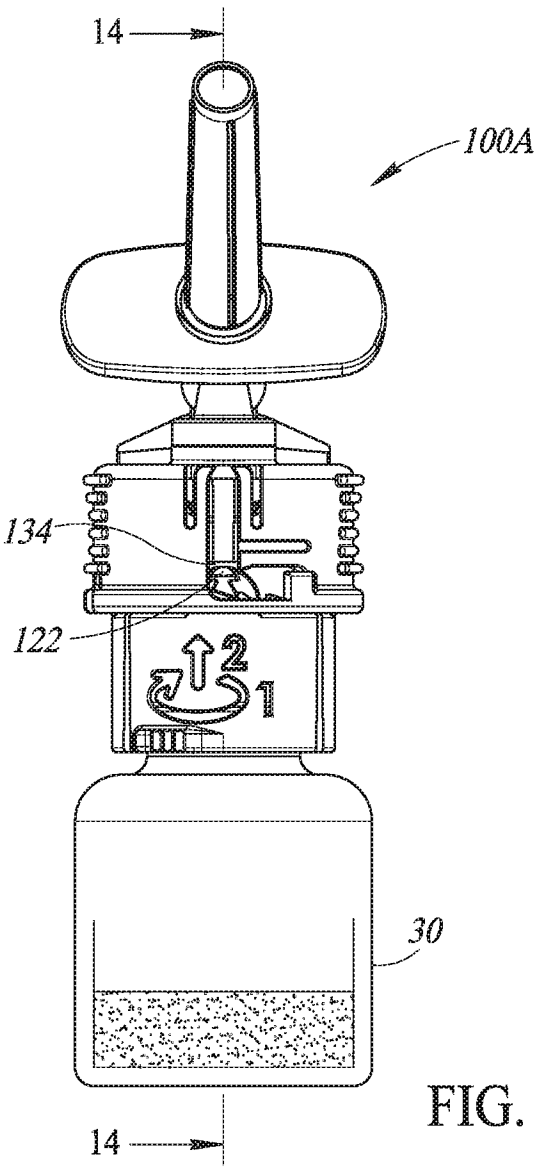
FIG. 13 is a front elevation view of the FIG. 3 liquid transfer device in an intermediate primed state mounted on the discrete injection vial.

FIG. 13 and FIG. 14 show the liquid transfer device 100A after a healthcare provider has held the diametric pair of anti-slip surfaces 129 in one hand and the applied a rotation force to the diametric pair of radial outward finger grips 109C to rotate the inner vial adapter body 102 relative to the outer vial adapter body 103 about the longitudinal vial adapter centerline 101A to an intermediate primed state. The radial outward projections 122 travel along the minor track legs 133 until they reach their respective junctures 134. The one-way passage arrangements 136 prevent returning the liquid transfer device 100A to its initial pre-compacted state from the intermediate primed state thereby precluding releasing the discrete injection vial 30. The proximal vial crown holding member sections 116 are rotated away from the discrete injection vial release apertures 131 thereby precluding use of the pincers-like hand tool 200 to release the intact discrete injection vial 30 from the liquid transfer device 100A.

Figure 16:
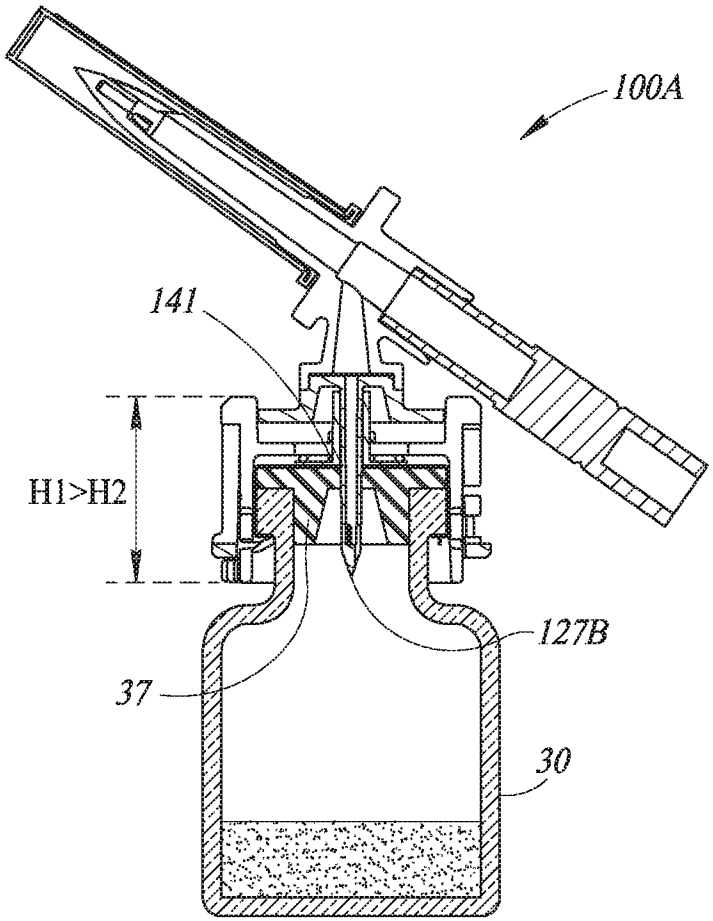
FIG. 16 is a longitudinal cross section of the FIG. 3 liquid transfer device mounted on the discrete injection vial along a cross section line 16-16 in FIG. 15.
Figure 15:
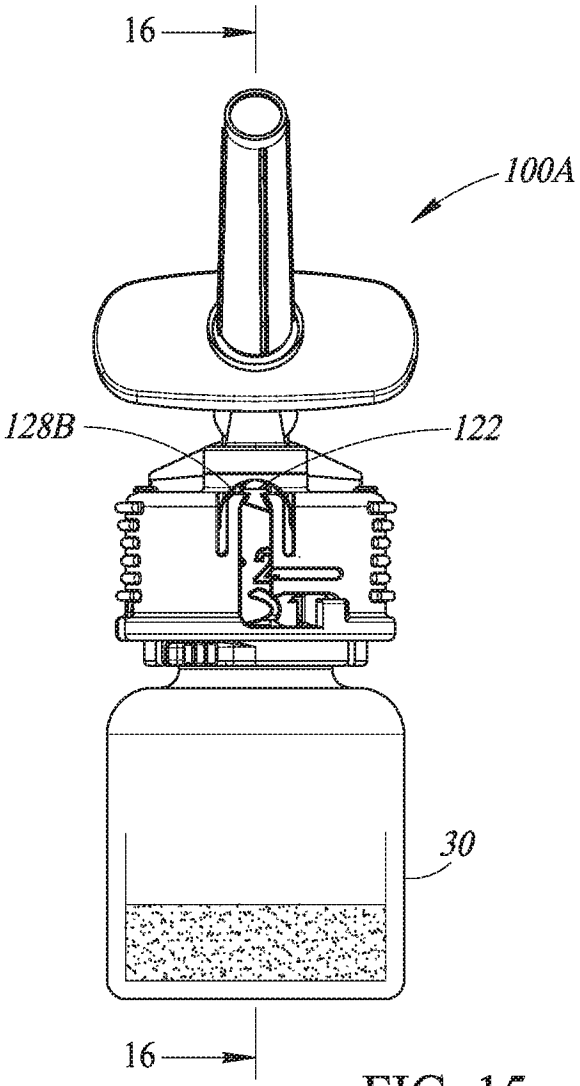
FIG. 15 is a front elevation view of the FIG. 3 liquid transfer device in a compacted state mounted on the discrete injection vial for flow communication therewith.

FIG. 15 and FIG. 16 show the liquid transfer device 100A in a final compacted state on telescopic mounting the outer vial adapter body 103 onto the inner vial adapter body 102 such that the outer vial adapter body 103 snugly receives the inner vial adapter body 102 therein. The radial outward projections 122 travel along the major track legs 132 until they pass through the one-way passage arrangements 137 at the finish track ends 128B thereby irreversible clamping the integral telescopic vial adapter 101 in its compacted state. The distal puncturing cannula tip 127B punctures the sealing member septum 141 and thereafter the injection vial stopper 37 for establishing flow communication between the puncturing cannula 127 and the vial tube 32 for preparing a medicated infusion liquid. The integral telescopic vial adapter 101 has a compacted height H2 between the uppermost transverse outer vial adapter body wall 123 and the lowermost vial crown sleeve rim 109A where H1>H2.

Figure 17:
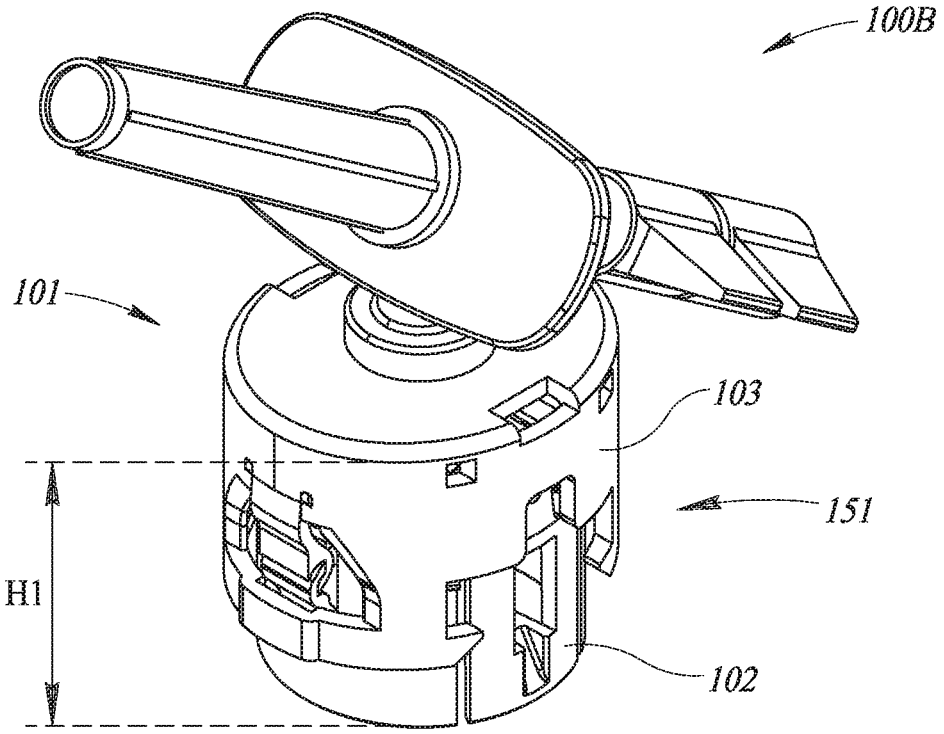
FIG. 17 is a front perspective view of a liquid transfer device having a pull release safety catch mechanism in a pre-compacted state.
Figure 18:
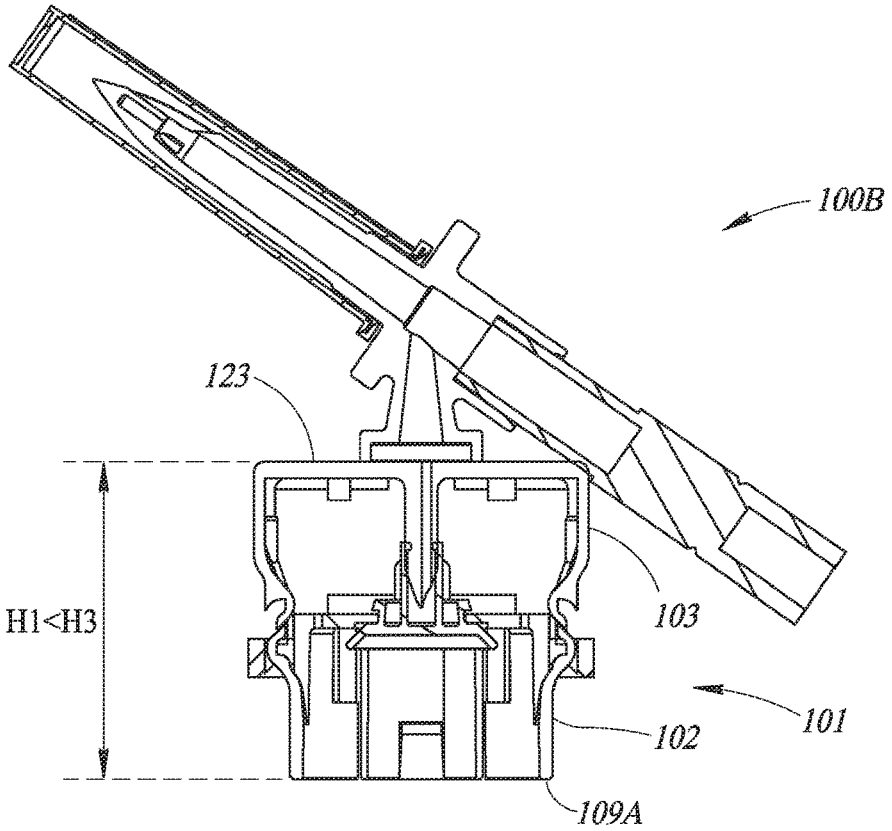
FIG. 18 is a longitudinal cross section of the FIG. 17 liquid transfer device in an intermediate primed state.
Figure 19:
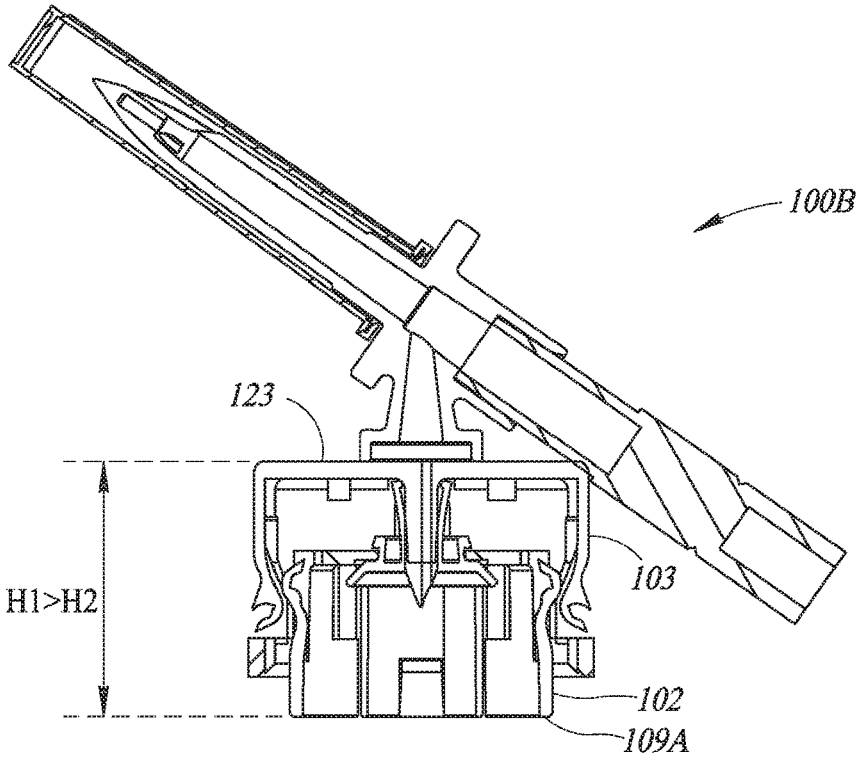
FIG. 19 is a longitudinal cross section of the FIG. 17 liquid transfer device in a compacted state.

FIG. 17 to FIG. 19 show a liquid transfer device 100B having a similar construction as the liquid transfer device 100A and therefore similar parts are likewise numbered. The latter 100B differs from the former 100A insofar as the latter 100B includes a pull release safety catch mechanism 151 as opposed to the twist release safety catch mechanism 104. FIG. 17 shows the liquid transfer device 100B in its pre-compacted state having a pre-compacted height H1. FIG. 18 shows the liquid transfer device 100B in its intermediate primed state having a primed vial adapter height H3 between the uppermost transverse outer vial adapter body wall 123 and the lowermost vial crown sleeve rim 109A where H3>H1 after an initial extension of the inner vial adapter body 102 from the outer vial adapter body 103 co-directional with the longitudinal vial adapter centerline 101A. FIG. 19 shows the liquid transfer device 100B in its compacted state having a compacted height H2 where H1>H2 after the outer vial adapter body 103 snugly telescopically receives the inner vial adapter body 102 therein.

Figure 20:
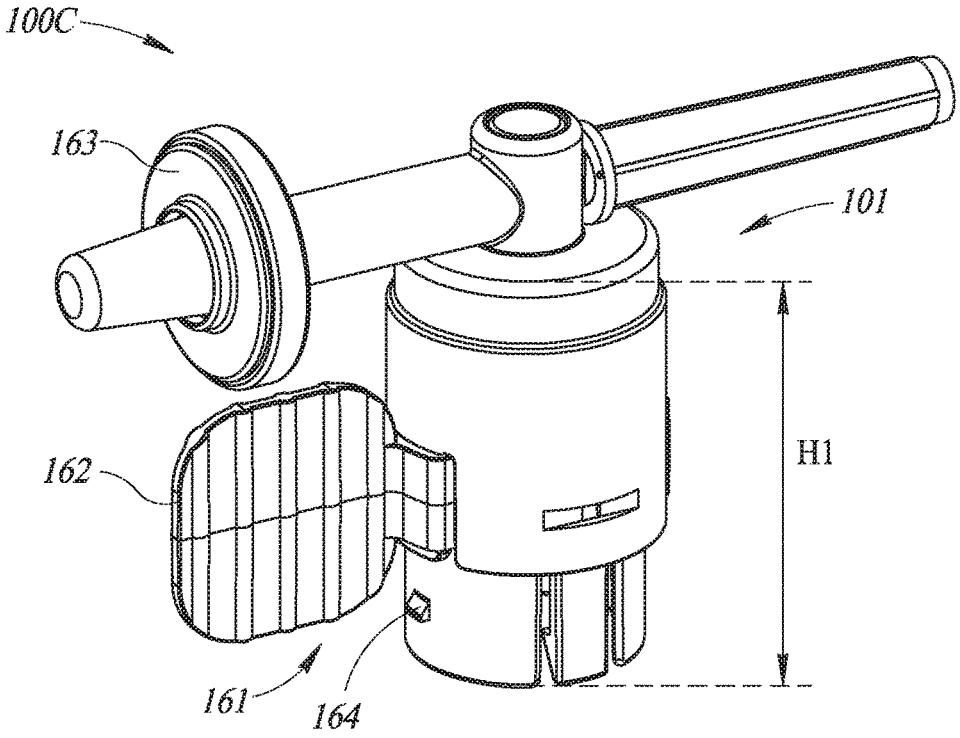
FIG. 20 is a front perspective view of a liquid transfer device having a safety catch mechanism with a safety catch in a pre-compacted state.
Figure 21:
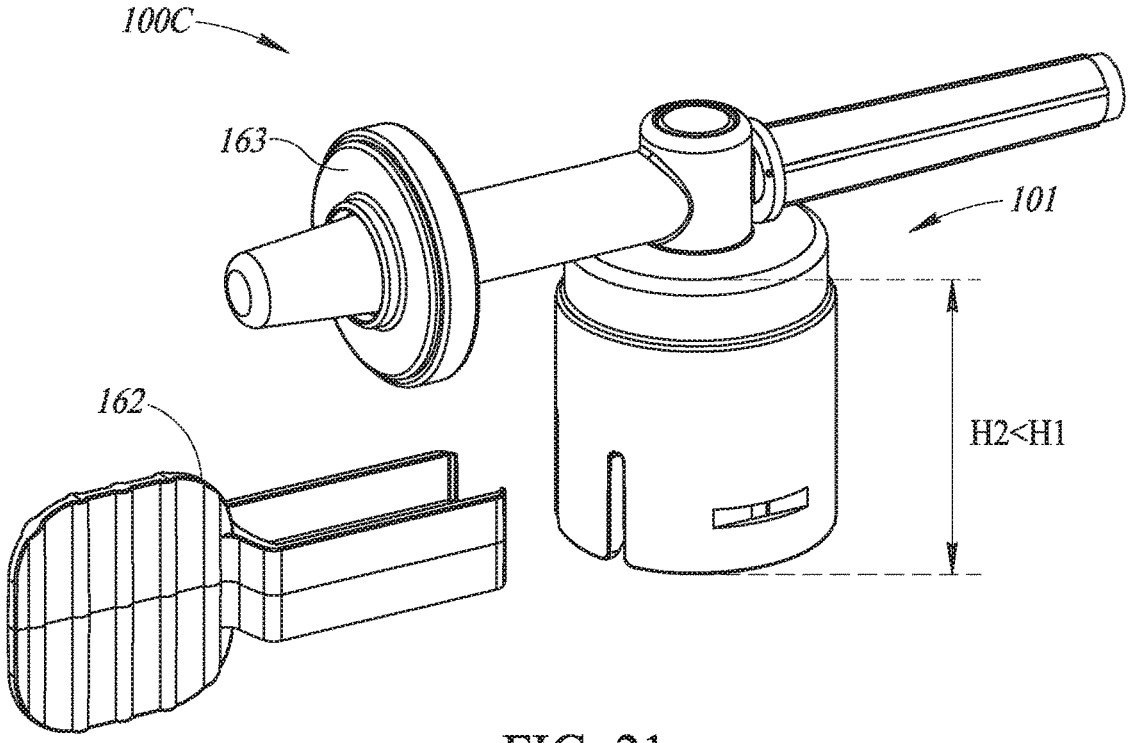
FIG. 21 is a front perspective view of the FIG. 20 liquid transfer device in a compacted state after removal of its safety catch.

FIG. 20 and FIG. 21 show a liquid transfer device 100C having a similar construction as the liquid transfer device 100A and therefore similar parts are likewise numbered. The latter 100C differs from the former 100A in several respects as follows: The latter 100C includes a safety catch mechanism 161 having a safety catch 162 as opposed to the twist release safety catch mechanism 104. The latter 100C includes a substitute IV port having a frangible member 163 which is broken off for enabling insertion of the IV spike 51 thereinto. The latter 100C includes a diametric pair of clamping members 164 constituting a component of a clamping arrangement for irreversible clamping the integral telescopic vial adapter 101 in a final compacted state.

FIG. 20 shows the safety catch 162 extending transversely through the outer vial adapter body 103 preventing manual compaction of the liquid transfer device 100C from its pre-compacted state to its compacted state. The integral telescopic vial adapter 101 has a pre-compacted height H1. FIG. 21 shows the liquid transfer device 100C in its compacted state after removal of the safety catch 162 from the outer vial adapter body 103 thereby enabling the outer vial adapter body 103 to snugly telescopically receive the inner vial adapter body 102 therein. The integral telescopic vial adapter 101 has a compacted height H2 where H1>H2.

While particular embodiments of the present invention are illustrated and described, it would be obvious to those skilled in the art that various other changes and modifications can be made without departing from the spirit and scope of the invention.

The invention claimed is:

1. A liquid transfer device for use with an infusion liquid container containing an infusion liquid and having an intravenous (IV) port for administering the infusion liquid, a discrete injection vial having a closed end vial tube containing a medicament, a tubular vial crown with a crown opening stopped by a non-punctured injection vial stopper, and an uppermost injection vial surface, and an infusion set including an infusion set IV spike for sealing insertion into a substitute IV port and a connector for administration purposes to a patient, the liquid transfer device comprising a trifurcated connector body having a liquid transfer device IV spike for sealing insertion into the infusion liquid container's IV port, a vial adapter port with an integral telescopic vial adapter for telescopic snap fit mounting on the discrete injection vial, and the substitute IV port for sealingly receiving the infusion set IV spike, said liquid transfer device IV spike, said vial adapter port and said substitute IV port being in 3 way direct and continuous fluid communication thereby enabling an initial forming of a medicated infusion liquid in the infusion liquid container and a subsequent administration of the mediated infusion liquid to a patient, said integral telescopic vial adapter having a longitudinal vial adapter centerline and comprising:

an inner vial adapter body having an inverted cup shape with an uppermost transverse annular inner vial adapter body wall and a downward depending vial crown sleeve with a lowermost vial crown sleeve rim, said inner vial adapter body bounding a vial crown cavity for snugly receiving the tubular vial crown on telescopic mounting said inner vial adapter body thereon, an outer vial adapter body having an inverted cup shape with an uppermost transverse outer vial adapter body wall and a downward depending skirt, said outer vial adapter body bounding an inner vial adapter body cavity for snugly telescopically receiving said inner vial adapter body therein on compacting said integral telescopic vial adapter from an initial pre-compacted state having a pre-compacted height H1 to a final compacted state having a compacted height H2 where H1>H2, wherein said pre-compacted height H1 and said compacted height H2 are between said uppermost transverse outer vial adapter body wall and said lowermost vial crown sleeve rim, a downward puncturing cannula with a proximal puncturing cannula opening in flow communication with said vial adapter port and a distal puncturing cannula tip for puncturing the injection vial stopper for flow communication with the vial tube, a safety catch mechanism for preventing inadvertent user compaction of said vial adapter from said pre-compacted state to said compacted state, and a clamping arrangement for irreversibly clamping said vial adapter in said final compacted state, said vial adapter being configured such that in said pre-compacted state, said distal puncturing cannula tip overlies the non-punctured injection vial stopper and, in compacted state, said distal puncturing cannula tip punctures through the injection vial stopper for flow communication with the vial tube.

2. The device according to claim 1 wherein said safety catch mechanism is constituted by a twist release safety catch mechanism including:

a diametric pair of L-shaped tracks in said outer vial adapter body, each said L-shaped track having a major track leg co-directional with said longitudinal vial adapter centerline, a minor track leg transverse to said longitudinal vial adapter centerline, a start track end adjacent said lowermost downward depending skirt rim and a finish track end adjacent said uppermost transverse outer vial adapter body wall, each said minor track leg including a one-way passage arrangement for irreversibly priming said integral telescopic vial adapter in an intermediate primed state, a diametric pair of radial outward projections on said inner vial adapter body for travelling along said diametric pair of L-shaped tracks from said start track end in said pre-compacted state to said finish track end in said compacted state, said twist release safety catch mechanism requiring an initial manual rotation of said inner vial adapter body with respect to said outer vial adapter body about said longitudinal vial adapter centerline for priming said vial adapter from an initial pre-compacted state to said intermediate primed state for enabling said compaction of said vial adapter from said pre-compacted state to said compacted state.

3. The device according to claim 2 wherein each said finish track end includes a one-way passage arrangement for irreversibly clamping said vial adapter in said final compacted state.

4. The device according to claim 2 wherein said inner vial adapter body has a diametric pair of radial outward finger grips towards said lowermost downward depending vial crown sleeve rim and said outer vial adapter body has a diametric pair of anti-slip surfaces orthogonal to said diametric pair of radial outward finger grips in said initial pre-compacted state for assisting said manual rotation of said inner vial adapter body with respect to said outer vial adapter body.

5. The device according to claim 1 wherein said safety catch mechanism is constituted by a pull release safety catch mechanism requiring an initial manual extension of said inner vial adapter body with respect to said outer vial adapter body co-directional with said longitudinal vial adapter centerline to an intermediate primed state to release said safety catch mechanism for enabling said compaction of said vial adapter from said pre-compacted state to said compacted state.

6. The device according to claim 1 wherein said safety catch mechanism includes a safety catch transversely extending through said outer vial adapter body in said pre-compacted state thereby blocking said compaction of said integral telescopic vial adapter from said pre-compacted state to said compacted state whereby a manual withdrawal of said safety catch from said outer vial adapter body enables said compaction of said integral telescopic vial adapter from said pre-compacted state to said compacted state.

7. The device according to claim 1 for use with an intact discrete injection vial release tool with an opposite pair of inward directed protrusions for applying a pincers-like compression for releasing a non-punctured intact discrete injection vial from said integral telescopic vial adapter, said vial crown sleeve including a major vial crown sleeve surround and a diametric pair of injection vial holding members pivotal with respect thereto such that each said vial crown holding member has a proximal vial crown holding member section and a distal vial crown holding member section, each said distal vial crown holding member section having a radial inward vial crown holding projection towards said lowermost vial crown sleeve rim for snap fitting under the vial crown on telescopic snap fitting said inner vial adapter body on the initially non-punctured intact discrete injection vial, said diametric pair of proximal vial crown holding member sections being pivotal with respect to said major vial crown sleeve surround such that application of the pincers-like compression on said diametric pair of proximal vial crown holding member sections distances said diametric pair of radial inward vial crown holding projections from said longitudinal vial adapter centerline for releasing the non-punctured intact discrete injection vial from said inner vial adapter body.

8. The device according to claim 7 wherein said downward depending skirt includes a diametric pair of through going discrete injection vial release apertures for providing access to the intact discrete injection vial release tool with the opposite pair of inward directed protrusions for applying the pincers-like compression in said pre-compacted state of said vial adapter.

9. The device according to claim 7 wherein said diametric pair of vial crown holding members pivot on said uppermost transverse annular inner vial adapter body wall on said application of the pincers-like compression.

10. The intact discrete injection vial release tool with the opposite pair of inward directed protrusions for use with the liquid transfer device according to claim 7 being configured as a pincers-like hand tool having an opposite pair of jaws with the opposite pair of inward directed protrusions.

* * * * *